US012117186B2

(12) United States Patent
Ewing et al.

(10) Patent No.: US 12,117,186 B2
(45) Date of Patent: Oct. 15, 2024

(54) AIR CONDITIONING APPLIANCE HAVING AN INTERNAL SHIELD

(71) Applicant: Haier US Appliance Solutions, Inc., Wilmington, DE (US)

(72) Inventors: Cody Ewing, Floyds Knobs, IN (US); Richard Michael Phillips, Louisville, KY (US); Joseph Robert Tobbe, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 190 days.

(21) Appl. No.: 17/734,445

(22) Filed: May 2, 2022

(65) Prior Publication Data

US 2023/0349564 A1 Nov. 2, 2023

(51) Int. Cl.

| | |
|---|---|
| ***F24F 1/0323*** | (2019.01) |
| ***F24F 1/027*** | (2019.01) |
| ***F24F 1/0284*** | (2019.01) |
| ***F24F 11/89*** | (2018.01) |
| ***F24F 13/20*** | (2006.01) |

(52) U.S. Cl.

CPC ..... *F24F 1/0323* (2019.02); *F24F 1/027* (2013.01); *F24F 1/0284* (2019.02); *F24F 11/89* (2018.01); *F24F 13/20* (2013.01)

(58) Field of Classification Search

CPC ..... F24F 1/027; F24F 11/89; F24F 1/0284; F24F 13/20; F24F 2013/205; F24F 13/08; F24F 13/082

See application file for complete search history.

(56) References Cited

U.S. PATENT DOCUMENTS

| | | | | |
|---|---|---|---|---|
| 2007/0006610 | A1 | 1/2007 | Kawasaki | |
| 2019/0003732 | A1* | 1/2019 | Seo | F24F 1/24 |
| 2021/0071881 | A1* | 3/2021 | Shaffer | F24F 1/0358 |

FOREIGN PATENT DOCUMENTS

| | | | |
|---|---|---|---|
| EP | 3182023 | B1 | 2/2021 |
| JP | 2008281286 | A | 11/2008 |
| WO | WO2014034564 | A1 | 3/2014 |
| WO | WO2021134903 | A1 | 7/2021 |

* cited by examiner

*Primary Examiner* — Schyler S Sanks
(74) *Attorney, Agent, or Firm* — Dority & Manning, P.A.

(57) ABSTRACT

A single-package air conditioner unit may include a housing, an outdoor heat exchanger, an indoor heat exchanger, an indoor air conduit, and an internal shield. The indoor fan may be held within a fan cowl defining a cowl outlet. The indoor air conduit may be mounted to the fan cowl and extend upward from the cowl outlet to an indoor outlet defined through the housing to guide air from the indoor fan. The indoor air conduit and the fan cowl may separate at least a portion of the indoor portion from the outdoor portion. The internal shield may be disposed within the outdoor portion rearward from the indoor air conduit and the fan cowl. The internal shield may extend between an upper edge and a lower edge. The lower edge may be disposed between the downward bottom end and the cowl outlet relative to a vertical direction.

20 Claims, 9 Drawing Sheets

AIR CONDITIONING APPLIANCE HAVING AN INTERNAL SHIELD

FIELD OF THE INVENTION

The present subject matter relates generally to air conditioning appliances, and more particularly to appliances having an internal shield disposed therein.

BACKGROUND OF THE INVENTION

Air conditioner or air conditioning appliance units are conventionally used to adjust the temperature within structures such as dwellings and office buildings. In particular, one-unit type room air conditioner units, such as single-package vertical units (SPVU), may be used to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through the indoor portion of the air conditioner unit. One or more components may separate the indoor portion from the outdoor portion.

Although the indoor portion may be separated from the outdoor portion, there is often the risk that moisture may seep into the indoor portion (e.g., such as from air humidity or liquid water that is sprayed to the outdoor portion, such as through a plenum). Moisture may be especially detrimental to performance of an air conditioning unit if the moisture or liquid flows to a path for indoor air or an electronics chamber (e.g., housing one or more electronic boards, such as a control or inverter board). Although resilient gaskets may be provided to seal the indoor portion from the outdoor portion, such arrangements might be susceptible to failure, especially if one or more resilient gaskets start to deteriorate over time.

Separate from or in addition concerns with moisture seeping into the indoor portion, issues may arise with controlling the flow of air (e.g., within the outdoor portion). It may be especially problematic if regions of stagnant air emerge, which may limit the volume of air or effective heat transfer to components in communication (e.g., fluid or thermal communication) with the outdoor portion.

As a result, it would be useful to have an appliance or features that mitigate the risk of water damage or flow to an indoor portion of the appliance (e.g., in a reliable, low-cost, or easily assembled manner). Additionally or alternatively, it would be useful to have an appliance or features that efficiently direct air flow or heat transfer within the outdoor portion (e.g., in a reliable, low-cost, or easily assembled manner).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a single-package air conditioner unit is provided. The single-package air conditioner unit may include a housing, an outdoor heat exchanger, an indoor heat exchanger, an indoor air conduit, and an internal shield. The housing may extend along a transverse direction between a forward front end and a rearward back end and along a vertical direction between a downward bottom end and an upward top end. The housing may define an outdoor portion proximal to the rearward back end and an indoor portion proximal to the forward front end. The outdoor heat exchanger assembly may be disposed in the outdoor portion and include an outdoor heat exchanger and an outdoor fan. The indoor heat exchanger assembly may be disposed in the indoor portion and include an indoor heat exchanger and an indoor fan. The indoor fan may be held within a fan cowl defining a cowl outlet. The indoor air conduit may be mounted to the fan cowl and extend upward from the cowl outlet to an indoor outlet defined through the housing to guide air from the indoor fan. The indoor air conduit and the fan cowl may separate at least a portion of the indoor portion from the outdoor portion. The internal shield may be disposed within the outdoor portion rearward from the indoor air conduit and the fan cowl. The internal shield may extend between an upper edge and a lower edge. The lower edge may be disposed between the downward bottom end and the cowl outlet relative to the vertical direction.

In another exemplary aspect of the present disclosure, a single-package air conditioner unit is provided. The single-package air conditioner unit may include a housing, an outdoor heat exchanger assembly, an indoor heat exchanger assembly, an electronics casing, a metal heat sink, an electronics board, and an internal shield. The housing may extend along a transverse direction between a forward front end and a rearward back end and along a vertical direction between a downward bottom end and an upward top end. The housing may define an outdoor portion proximal to the rearward back end and an indoor portion proximal to the forward front end. The outdoor heat exchanger assembly may be disposed in the outdoor portion and comprising an outdoor heat exchanger and an outdoor fan. The indoor heat exchanger assembly may be disposed in the indoor portion and include an indoor heat exchanger and an indoor fan. The electronics casing may be disposed in the outdoor portion apart from the outdoor heat exchanger. The electronics casing may define a board chamber. The metal heat sink may be mounted to the electronics casing. The electronics board may be mounted within the board chamber in thermal communication with the metal heat sink. The internal shield may be disposed within the outdoor portion rearward from the electronics casing. The internal shield may extend between an upper edge and a lower edge. The lower edge may be disposed below the electronics casing relative to the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
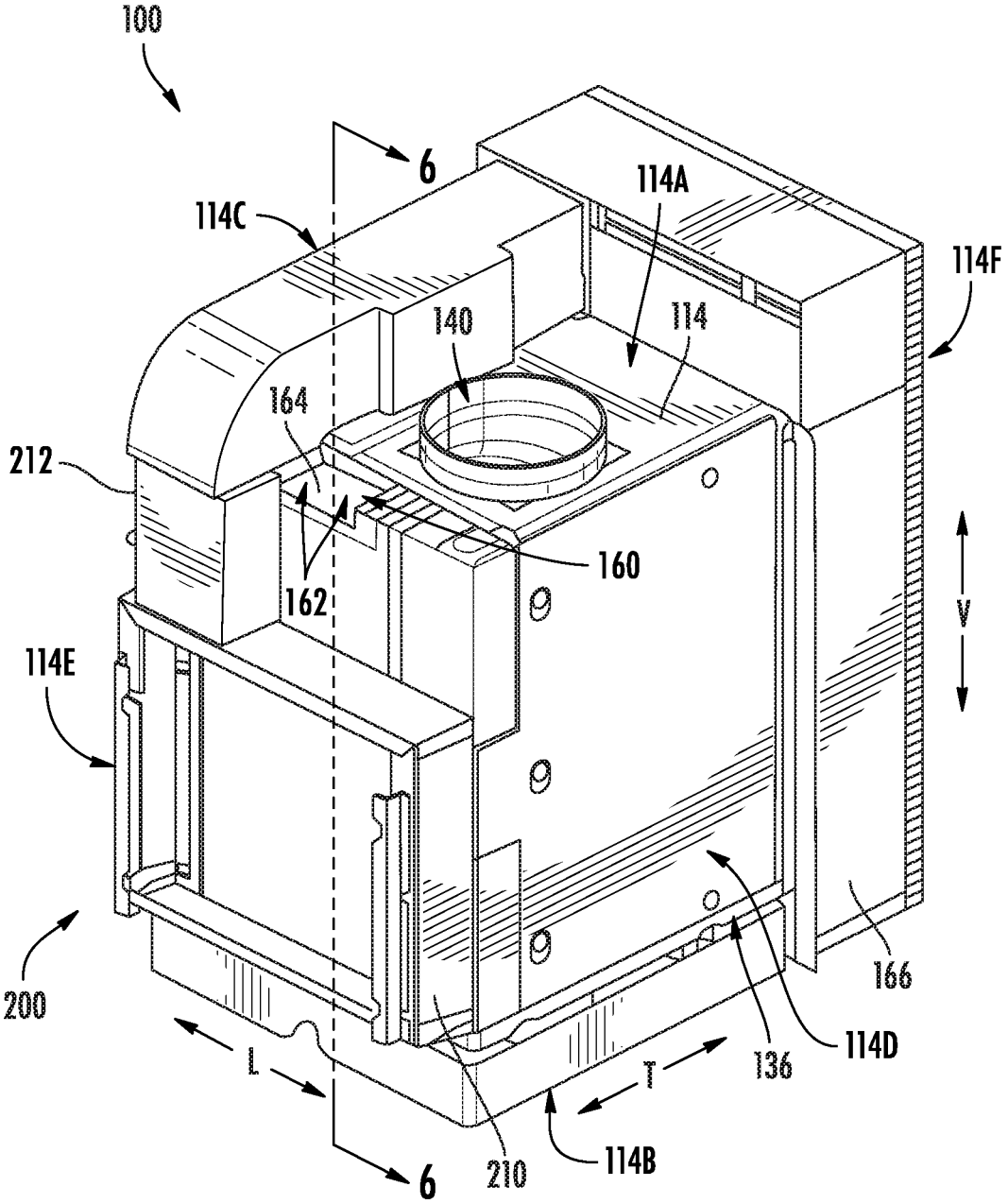
FIG. 1 provides a perspective view of an air conditioning appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure describes exemplary embodiments of a single-package air conditioner that includes a separate indoor portion and outdoor portion. Within the outdoor portion, an internal shield may block certain portions of the air conditioner from air or moisture that is pulled into the outdoor portion directly from an outdoor inlet. For instance, the internal shield may block a seam or connection point that separates the outdoor portion from the indoor portion. Additionally or alternatively, the internal shield may passively guide air flowing within the outdoor portion, preventing air from stagnating within the outdoor portion.

Figure 2:
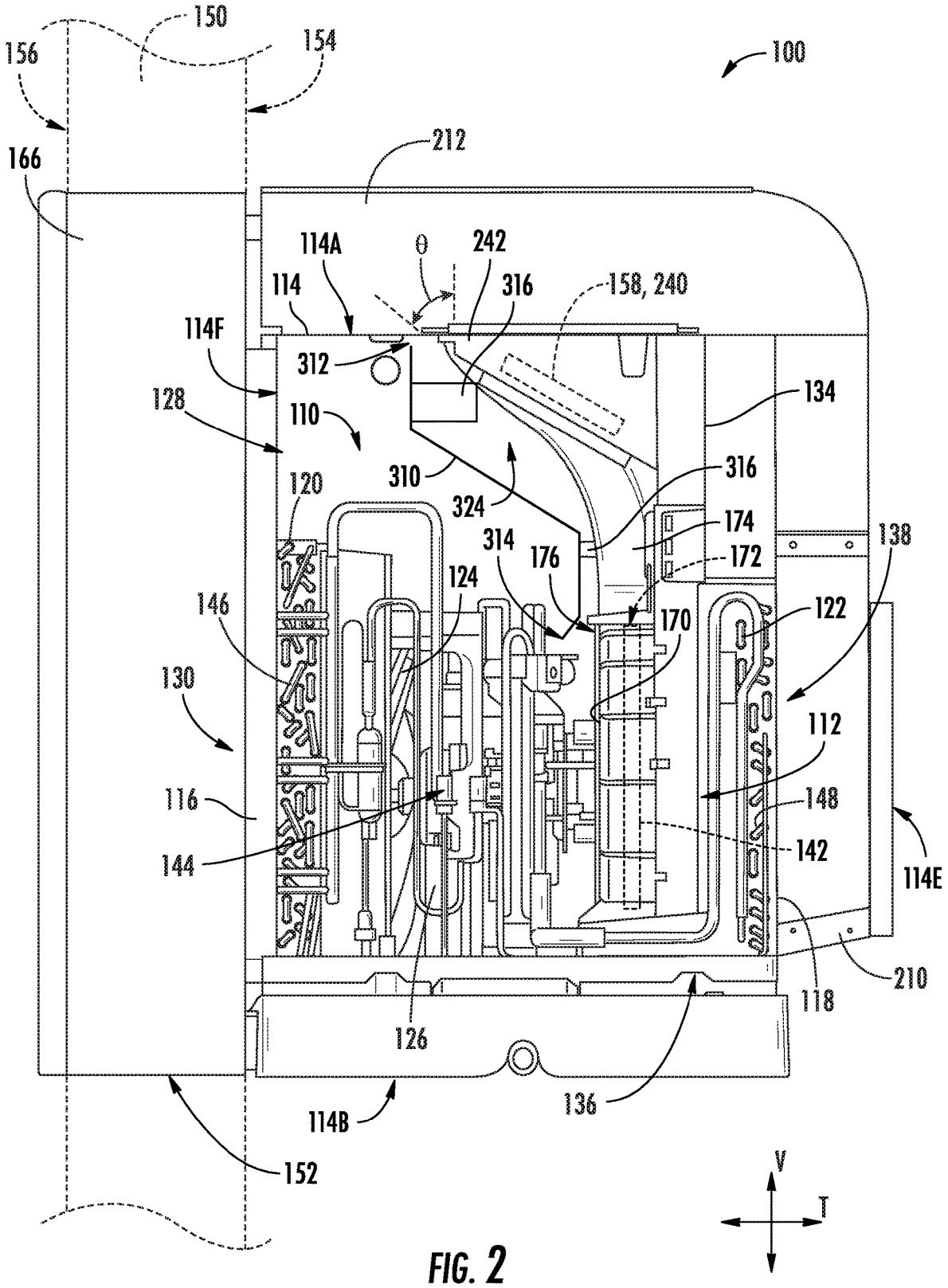
FIG. 2 provides a partially-transparent elevation view of the exemplary air conditioner unit of FIG. 1.
Figure 3:
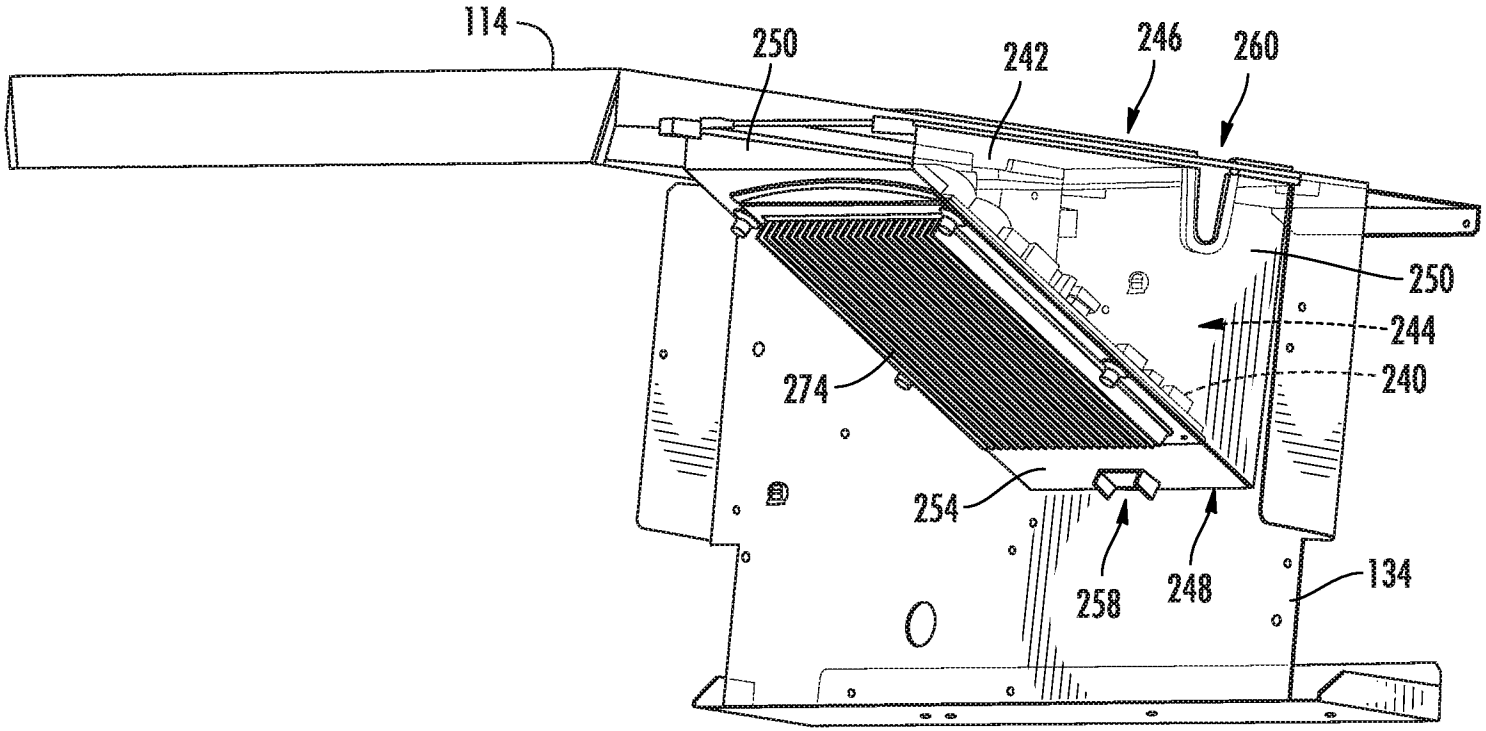
FIG. 3 provides a perspective view of a casing assembly of the exemplary air conditioner unit of FIG. 1.
Figure 4:
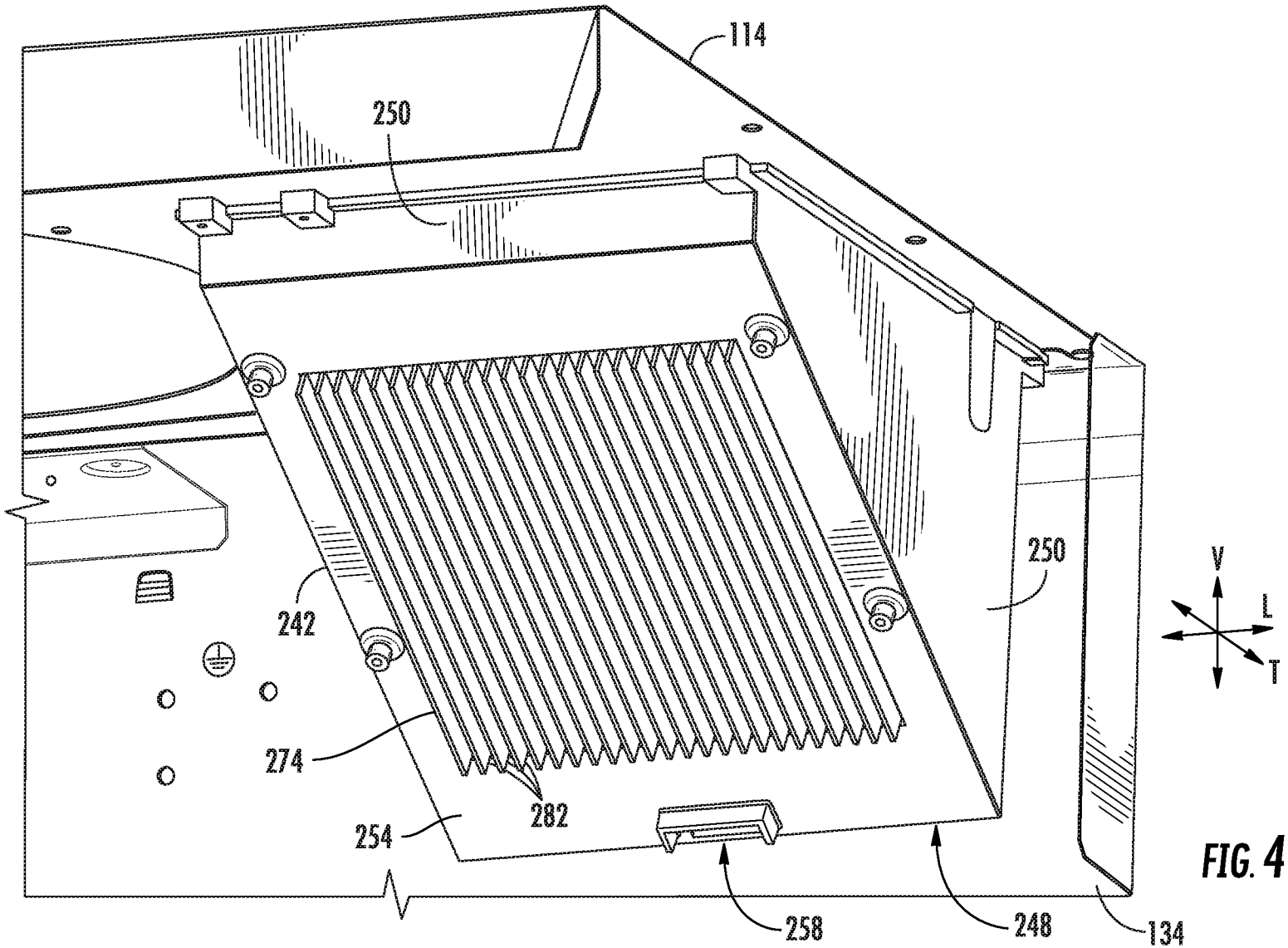
FIG. 4 provides a magnified perspective view of the exemplary casing assembly of FIG. 3.
Figure 5:
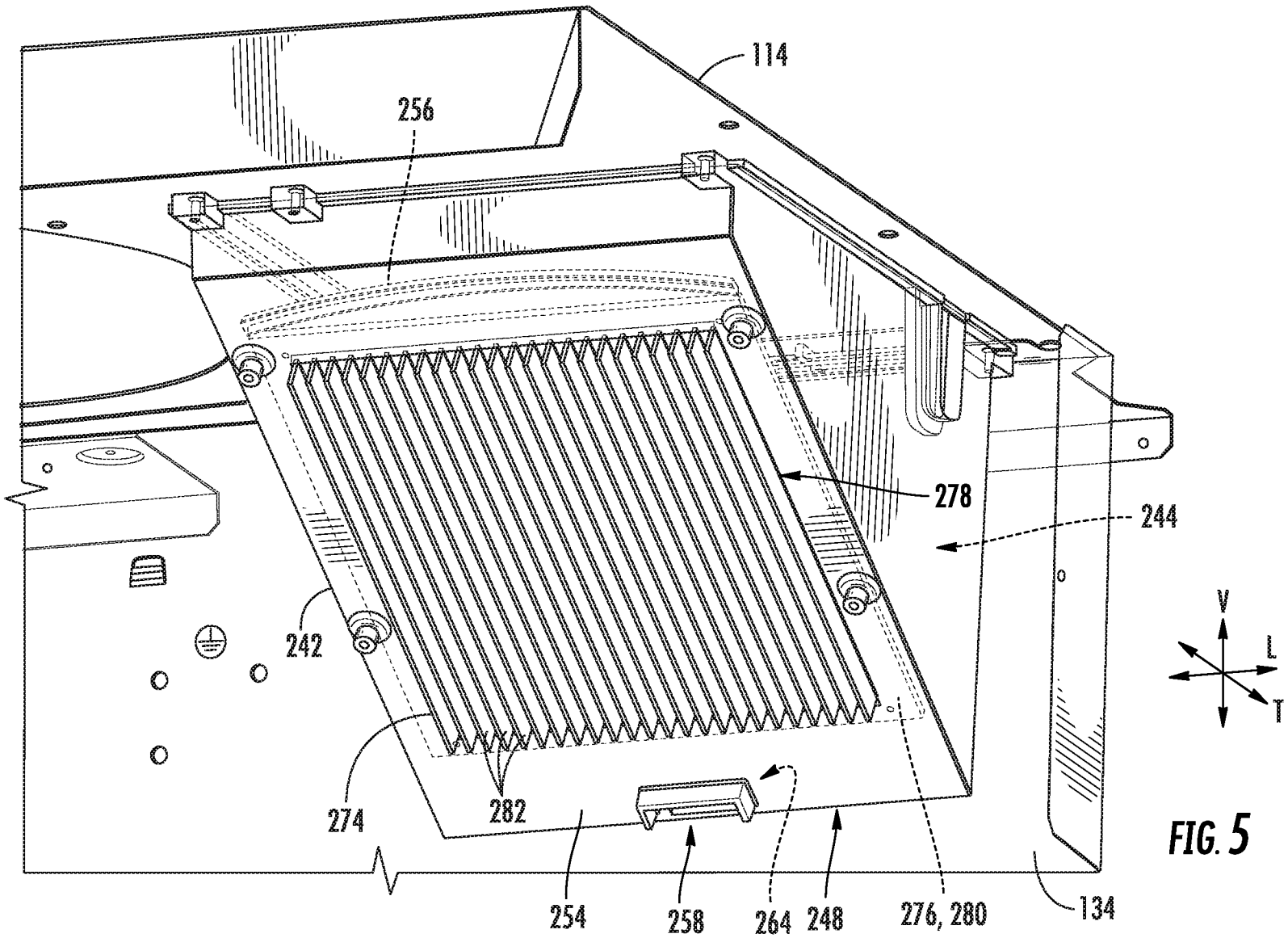
FIG. 5 provides a partially transparent, magnified, perspective view of the exemplary casing assembly of FIG. 3.

Turning now to the figures, FIGS. 1 and 2 illustrate an exemplary air conditioner appliance (e.g., air conditioner 100). As shown, air conditioner 100 may be provided as a one-unit type air conditioner 100, such as a single-package vertical unit. Generally, air conditioner 100 defines a vertical direction V, lateral direction L, and transverse direction T. Each direction V, L, T is perpendicular to each other, such that an orthogonal coordinate system is generally defined.

Air conditioner 100 includes a package housing 114 or cabinet 114 that extends along the vertical direction V between a downward bottom end 114A and an upward top end 114B, along a lateral direction L between a first lateral side 114C and a second lateral side 114D, and along the transverse direction T between a forward front end 114E and a rearward back end 114F. As shown, housing 114 defines an indoor portion 112 and an outdoor portion 110. In this regard, as used herein, the terms "cabinet," "housing 114," and the like are generally intended to refer to an outer frame or support structure for appliance 100 (e.g., including any suitable number, type, and configuration of support structures formed from any suitable materials, such as a system of elongated support members, a plurality of interconnected panels, or some combination thereof). It should be appreciated that housing 114 does not necessarily require an enclosure and may simply include open structure supporting various elements of appliance 100. By contrast, housing 114 may enclose some or all portions of an interior of housing 114. It should be appreciated that housing 114 may have any suitable size, shape, and configuration while remaining within the scope of the present subject matter.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) may be spaced apart from each other along the transverse direction T. The rear opening 116 may be part of the outdoor portion 110, while the front opening 118 is part of the indoor portion 112. Components of the outdoor portion 110, such as an outdoor heat exchanger 120, outdoor fan 124, and compressor 126 may be enclosed within housing 114 between front opening 118 and rear opening 116. In certain embodiments, one or more components of outdoor portion 110 are mounted on a basepan 136, as shown.

During certain operations, air may be drawn to outdoor portion 110 through rear opening 116. Specifically, an outdoor inlet 128 defined through housing 114 may receive outdoor air motivated by outdoor fan 124. Within housing 114, the received outdoor air may be motivated through or across outdoor fan 124. Moreover, at least a portion of the outdoor air may be motivated through or across outdoor heat exchanger 120 before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable discrete orientation.

As shown, indoor portion 112 may include an indoor heat exchanger 122, an indoor fan 142, or a heating unit (e.g., one or more resistive coils—not pictured). These components may, for example, be housed behind the front opening 118. A bulkhead 134 may generally support or house various other components or portions thereof of the indoor portion 112, such as the indoor fan 142. When assembled, 134 may generally separate and define the indoor portion 112 and outdoor portion 110 within housing 114. Additionally or alternatively, bulkhead 134 or indoor heat exchanger 122 may be mounted on basepan 136 (e.g., at a higher vertical position than outdoor heat exchanger 120), as shown.

In certain embodiments, a fan cowl 170 holds or at least partially encloses indoor fan 142. Such a fan cowl 170 may be attached to a separate wall or segment of bulkhead 134, as would generally be understood. In turn, fan cowl 170 may be included or formed with bulkhead 134.

Separately from or in addition to fan cowl 170, an indoor air conduit 174 may be included or formed with bulkhead 134. Generally, indoor air conduit 174 forms a portion of the air path from indoor fan 142 to guide air from indoor fan 142 to a downstream indoor outlet 140 that is defined through housing 114 (e.g., through a top wall of housing 114 above indoor inlet 138 along the vertical direction V). In some embodiments, indoor air conduit 174 is mounted to fan cowl 170 on or about a cowl outlet 172. Thus, a seam or intersection line 176 may be formed between fan cowl 170 and indoor air conduit 174. As shown, indoor air conduit 174 may extend upward from the cowl outlet 172 to indoor outlet 140. Moreover, indoor air conduit 174 and fan cowl 170 may separate least a portion of the indoor portion 112 from the outdoor portion 110 (e.g., as part of bulkhead 134). Thus, indoor air conduit 174 and fan cowl 170 may have an outer surface (e.g., outside the path of air to indoor outlet 140) that lies within outdoor portion 110.

During certain operations, air may be drawn to indoor portion 112 through front opening 118. Specifically, an indoor inlet 138 defined through housing 114 may receive indoor air motivated by indoor fan 142. At least a portion of the indoor air may be motivated through or across indoor heat exchanger 122 (e.g., before passing to fan cowl 170). From indoor fan 142, indoor air may be motivated (e.g., through indoor air conduit 174) and returned to the indoor area of the room through indoor outlet 140. Optionally, one or more conduits (not pictured) may be mounted on or downstream from indoor outlet 140 to further guide air from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchanger 120, 122 may be components of a thermodynamic assembly (e.g., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on basepan 136) and an expansion device 144 (e.g., expansion valve or capillary tube), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

It is noted that although a sealed system is described above, one of ordinary skill in the art would, in light of the present disclosure, understand that such a sealed system may be substituted for other suitable heat-exchange systems, such as a system relying on shape-memory alloys (SMA). For instance, a pair of discrete fluid circuits (e.g., a hot circuit and a cold circuit) each having a discrete volume of heat-carrying fluid (e.g., water, brine, glycol, air, etc.) may be separately connected to a compression unit housing a plurality of plate stacks each having one or more plates formed from one or more SMA material (e.g., copper-nickel-aluminum or nickel-titanium). Separate heat exchangers may generally be provided on the circuits in place of or as the above-described indoor heat exchanger and the outdoor heat exchanger. In particular, a first heat exchanger may be provided on the cold circuit (e.g., in place of the indoor heat exchanger of a sealed system) to absorb heat from the adjacent air and impart such absorbed heat to the heat-carrying fluid within the cold circuit. Similarly, a second heat exchanger may be provided on the hot circuit (e.g., in place of the outdoor heat exchanger of a sealed system) to release heat to the adjacent air from the heat-carrying fluid within the hot circuit.

The compression unit may facilitate or direct heat between the circuits. As an example, the compression unit may have four discrete plate stacks, each being separately compressed or released by a corresponding compressor or vice (e.g., hydraulic ram or electric actuator). During use, the plate stacks may be compressed and released (e.g., alternated between a compressed state or stroke and a released state or stroke) separately such that at any given moment one plate stack is compressed, one plate stack is released, one plate stack is mid-compression, and one plate stack is mid-release. Heat-carrying fluid in the cold circuit may flow through the first heat exchanger, before being directed (e.g., by a series of valves or pumps) into the plate stack that is currently compressed. The compressed plate stack may then be moved to the released state, in turn absorbing heat from the heat-carrying fluid before the heat-carrying fluid within the now-released plate stack is returned to the cold circuit (e.g., to repeat the cycle). In contrast to the cold circuit, heat-carrying fluid in the hot circuit may flow through the second heat exchanger and be directed (e.g., by a separate series of valves or pump) into the plate stack that is currently released. The released plate stack may then be compressed (i.e., moved to the compressed stated), in turn releasing heat from the plate stack to the heat-carrying fluid before the heat-carrying fluid within the now-compressed plate stack is returned to the hot circuit (e.g., to repeat the cycle). The use of four plate stacks may allow both circuits to run continuously. Moreover, such a process may be reversed, such that the above described hot circuit operates as a cold circuit, and vice versa.

Returning generally to FIGS. 1 and 2, a plenum 166 may be provided to direct air to or from housing 114. When installed, plenum 166 may be selectively attached to (e.g., fixed to or mounted against) housing 114 (e.g., via a suitable mechanical fastener, adhesive, gasket, etc.) and extend through a structure wall 150 (e.g., an outer wall of the structure within which air conditioner 100 is installed). For instance, plenum 166 may extend (e.g., parallel to the transverse direction T) through a hole or channel 152 in the structure wall 150 that passes from an internal surface 154 to an external surface 156.

Figure 7:
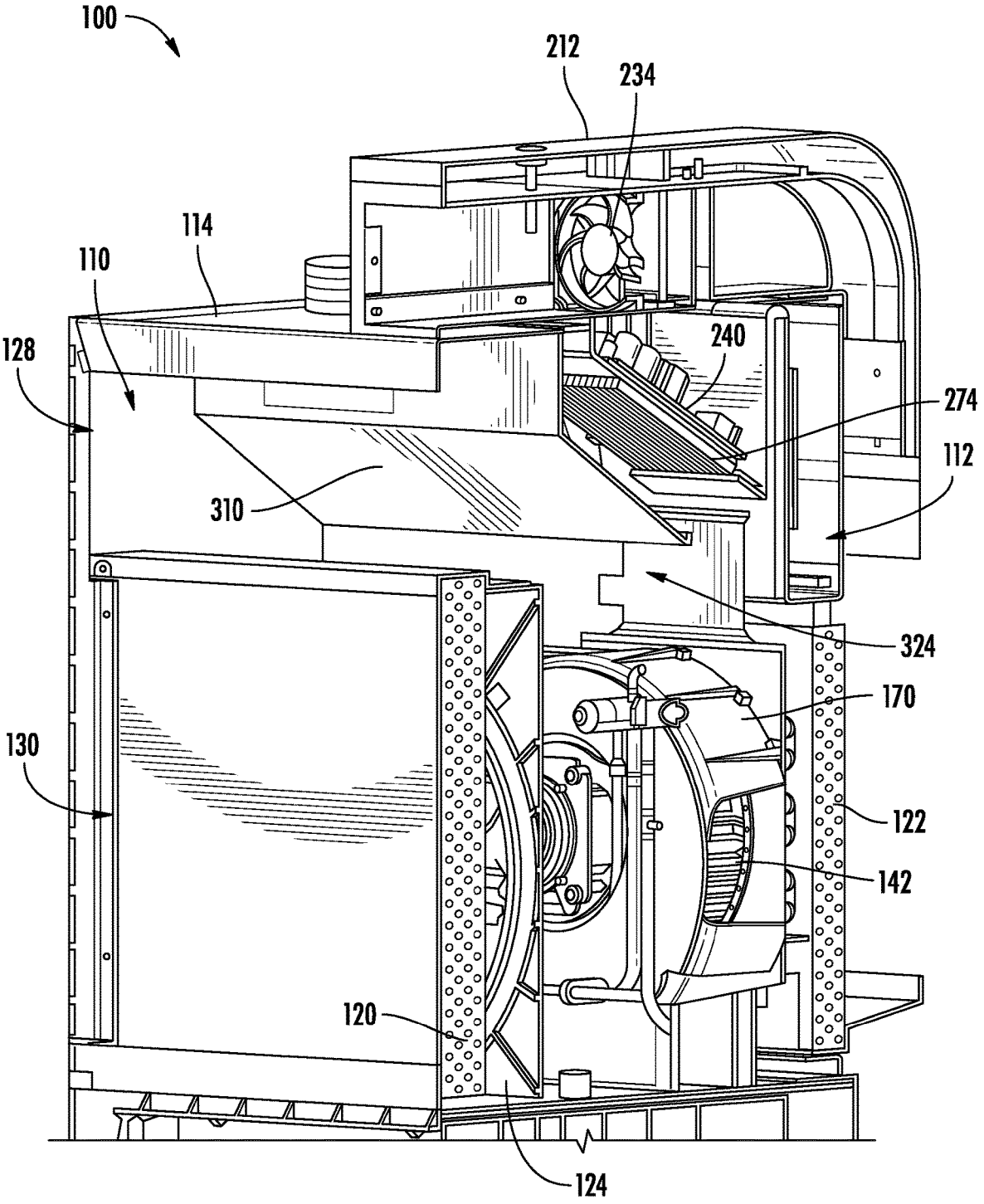
FIG. 7 provides a cross-sectional perspective view of the exemplary air conditioner unit of FIG. 1, taken along the lines 6-6.
Figure 8:
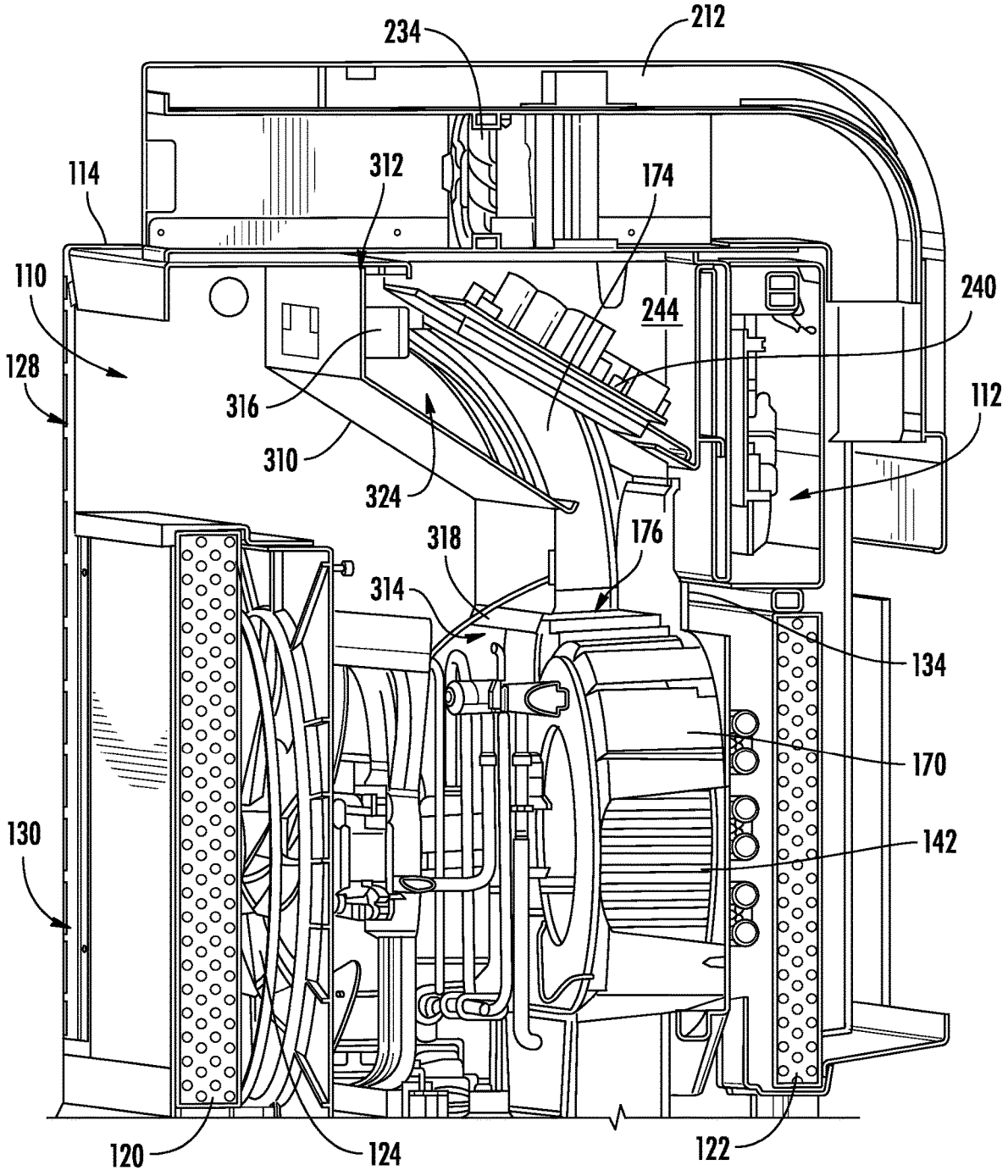
FIG. 8 provides another cross-sectional perspective view of the exemplary air conditioner unit of FIG. 1, taken along the lines 6-6.
Figure 9:
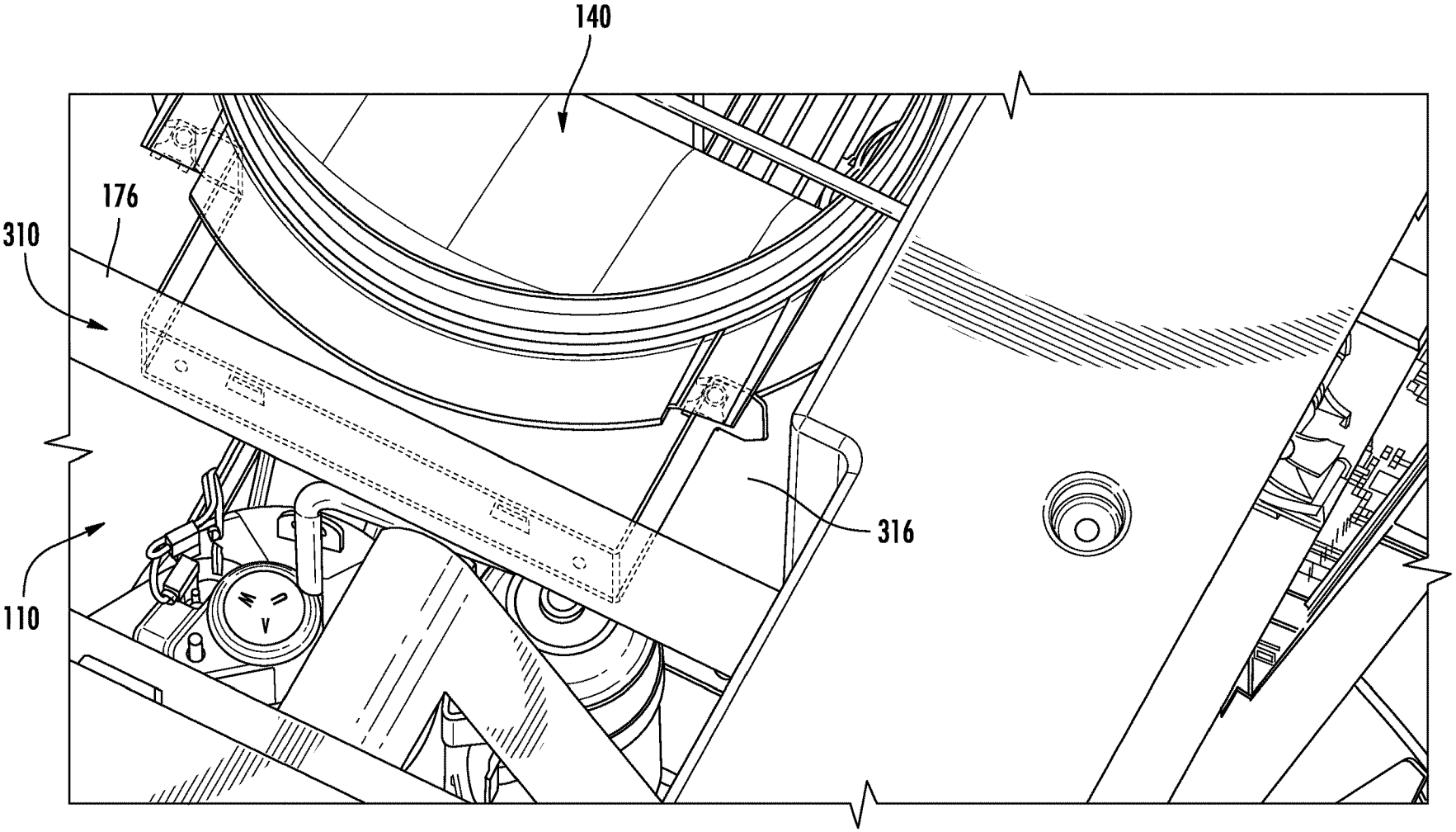
FIG. 9 provides an upper perspective view FIG. 7 of the exemplary air conditioner unit of FIG. 1, wherein a portion of an upper wall of the housing has been removed for clarity.

In optional embodiments, a make-up air assembly 200 is provided to selectively direct outdoor or make-up air to the indoor portion 112. Specifically, make-up air assembly 200 may direct outdoor air through the structure outer or wall 150 of the structure within which air conditioner 100 is installed (e.g., via plenum 166) and to indoor heat exchanger 122 without first directing such outdoor or make-up air through housing 114. To that end, make-up air assembly 200 may include one or more air ducts or conduits (e.g., intake conduit 210 or secondary air duct 212) defining one or more air paths outside of housing 114. During use, the flow of make-up air (e.g., as motivated by a make-up fan 234-FIGS. 7 and 8) may thus be fluidly isolated from the flow of air through outdoor portion 110.

The operation of air conditioner 100 including compressor 126 (or the sealed system generally), indoor fan 142, outdoor fan 124, heating unit, make-up fan 234, and other suitable components may be controlled by a controller 158 (e.g., control board, inverter board, etc.). Controller 158 may be in communication (via for example a suitable wired or wireless connection) to such components of the air conditioner 100. By way of example, the controller 158 may include one or more electronics boards (e.g., mounted together or separately within housing 114). In some embodiments, controller 158 includes a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH. Optionally, controller 158 may include one or more electronic components (e.g., provided on an inverter board) for powering components to which the controller 158 is in communication with. Thus, controller 158 may facilitate or direct the change of a current between a direct and alternating current, as would be understood.

Generally, controller 158 may be mounted at any suitable location on or within housing 114. In particular, at least one electronics board 240 (e.g., such as a control board or inverter board of controller 158) may be housed or mounted within an electronics casing 242, as will be described in greater detail below. In some embodiments, electronics casing 242 is disposed apart from indoor portion 112 within outdoor portion 110. For instance, electronics casing 242 may be spaced apart from (e.g., above) outdoor heat exchanger 120. As shown, electronics casing 242 may be secured on or supported by one or more internal panels of air conditioner 100. In exemplary embodiments, electronics casing 242 is mounted to, or partially formed by, bulkhead 134 (e.g., opposite of indoor fan 142). In additional or alternative embodiments, electronics casing 242 may be disposed above cowl outlet 172 relative to the vertical direction V. For instance, electronics casing 242 may be mounted to, or partially formed by, an outer panel of housing 114 (e.g., a top end 114B of housing 114 or outdoor portion 110). In further additional or alternative embodiments, electronics casing 242 is mounted adjacent to the indoor air conduit 174. For instance, electronics casing 242 laterally spaced apart from indoor air conduit 174 (e.g., at a common vertical height).

Air conditioner 100 may additionally include a control panel 160 and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Turning now especially to FIGS. 3 through 9, electronics casing 242 may be held or mounted on one or more panels within outdoor portion 110, as noted above. Electronics casing 242 itself may extend along the vertical direction V between a top casing end 246 and a bottom casing end 248. When assembled, bottom casing end 248 may be held within outdoor portion 110. Additionally or alternatively, top casing end 246 may be held at or above outdoor portion 110. For instance, top casing end 246 may be held above a top wall of housing 114 (e.g., through which electronics casing 242 is mounted).

Between the top casing end 246 and a bottom casing end 248, electronics casing 242 defines a board chamber 244. Specifically, one or more casing walls (e.g., sidewalls 250, angled casing wall 254, etc.) may define board chamber 244 as a separate or discrete chamber within outdoor portion 110 and within which electronics board 240 may be mounted. As shown, a plurality of sidewalls 250 may define a vertical opening 252 (e.g., at top casing end 246) through which a user or service person may access board chamber 244, such as to install, remove, or service electronics board 240. Thus, the plurality of sidewalls 250 may form an upper edge or perimeter of electronics casing 242. Optionally, the vertical opening 252 may be open or extend through housing 114, such as through a top wall of housing 114. In turn, board chamber 244 may notably be accessible (e.g., to a user or service person) without requiring disassembly of housing 114 or otherwise forcing a user to access the region of outdoor portion 110 that surrounds electronics casing 242. As noted above, top casing end 246 may be held above a top wall of the housing 114. In some such embodiments, the upper edge or perimeter of electronics casing 242 may thus extend above an exterior surface of the housing 114, advantageously restricting water flow (e.g., horizontal water flow) to the vertical opening 252.

In certain embodiments, one or more of the sidewalls 250 extend along (e.g., parallel to) the vertical direction V. In other words, one or more of the sidewalls 250 may form one or more planar surfaces (e.g., exterior or interior surface) that lie in a plane parallel to the vertical direction V. In the illustrated embodiments, the plurality of sidewalls 250 include at least a portion of bulkhead 134 and multiple other sidewalls 250 formed from a single continuous or integral panel. Nonetheless, it is understood that alternative embodiments may include a plurality of discrete walls joined together, as would be understood.

Separate from or in addition to the plurality of sidewalls 250, the electronics casing 242 may include an angled casing wall 254. As shown, angled casing wall 254 extends along a wall angle θ that is non-orthogonal and non-parallel relative to the vertical direction V. In other words, angled casing wall 254 may form one or more planar surfaces (e.g., exterior or interior surface) that lie in a plane on the wall angle θ. Optionally, the wall angle θ may be between approximately 30° and 60° (e.g., relative to the vertical direction V). Additionally or alternatively, the wall angle θ may be approximately 45°.

Generally, angled casing wall 254 is held between the top casing end 246 and the bottom casing end 248. In some embodiments, angled casing wall 254 extends to the bottom casing end 248. Angled casing wall 254 may extend (e.g., generally downward) from one of the plurality of sidewalls 250. For instance, relative to the vertical direction V, angled casing wall 254 (or wall angle θ) may extend from one of the plurality of sidewalls 250 to bottom casing end 248 (or a bottom wall provided at the same). Optionally, angled casing wall 254 may extend downward toward the indoor portion 112. In other words, angled casing wall 254 may descend along the vertical direction V relative to proximity to indoor portion 112 (e.g., relative to the transverse direction T). Additionally or alternatively, relative to a horizontal direction (e.g., lateral direction L), angled casing wall 254 may extend between multiple (e.g., opposing) sidewalls 250. Moisture entering the board chamber 244 may thus be directed along the sidewalls 250 and down the angled casing wall 254 (e.g., toward the bottom casing end 248).

In optional embodiments, an arched interior ridge 256 is disposed on angled casing wall 254. In particular, arched interior ridge 256 may be disposed on angled casing wall 254 within board chamber 244. Thus, arched interior ridge 256 may be mounted to or formed with an interior surface 264 of angled casing wall 254 (e.g., as a vertically raised rim or groove). As shown, arched interior ridge 256 may be arched upward to form a convex curve or arc shape. The terminal points of the arched interior ridge 256 may thus be located proximal to the bottom of angled casing wall 254 (e.g., proximal to bottom casing end 248) relative or in comparison to the crest of arched interior ridge 256. Moreover, the terminal points of the arched interior ridge 256 may be spaced apart (e.g., horizontally) from the sidewalls 250 (e.g., opposing sidewalls 250) of electronics casing 242. Liquids flowing along angled casing wall 254 may thus be directed to flow outward toward the terminal points as such water flows downward and, for example, between a terminal point and an opposing sidewall 250.

In some embodiments, electronics casing 242 defines a weep hole 258. Generally, weep hole 258 may extend through on or more of the casing walls. Specifically, weep hole 258 may extend from board chamber 244 to the outdoor portion 110. For instance, weep hole 258 may extend (e.g., vertically) through bottom wall. Additionally or alternatively, weep hole 258 may be defined at bottom casing end 248. Thus, liquids or water within electronics casing 242 may be permitted to pass from board chamber 244 (e.g., to outdoor portion 110 as motivated by gravity). Separate from or in addition to the weep hole 258, electronics casing 242 may define one or more horizontal channels 260 extending through one or more of the casing walls. For instance, one or more of the sidewalls 250 may define a horizontal channel 260 extending therethrough. In some such embodiments, the horizontal channel 260 (e.g., channels) may be defined at the top casing end 246. Optionally, the horizontal channel 260 may be open along the vertical direction V and, thus, interrupt the upper edge or perimeter of vertical opening 252.

A casing lid 266 may be provided to selectively cover the vertical opening 252. As shown, casing lid 266 may generally include an upper platform 268 that can be alternately placed over vertical opening 252 (e.g., to cover vertical opening 252 and restrict access to board chamber 244) and apart from vertical opening 252 (e.g., to uncover vertical opening 252 and permit access to board chamber 244). In some embodiments, casing lid 266 may be removably disposed on housing 114 (e.g., a top wall of housing 114). For instance, a bottom surface of upper platform 268 may rest on the upper edge or perimeter of the vertical opening 252 above housing 114.

A metal heat sink 274 is provided in certain embodiments to facilitate heat transfer from board chamber 244. Specifically, metal heat sink 274 may be mounted to the angled casing wall 254 (e.g., via one or more mechanical fasteners, adhesives, welds, etc.). In some such embodiments, metal heat sink 274 includes a sink platter 276 that is disposed within board chamber 244. Optionally, a heat transfer or sink aperture 278 is defined through angled casing wall 254 to permit convective heat transfer across metal heat sink 274. Although sink aperture 278 extends through angled casing wall 254, metal heat sink 274 may cover the same. For instance, sink platter 276 may form a lap joint rim 280 that is larger or disposed outward from sink aperture 278. Moreover, lap joint rim 280 may be disposed against an interior surface 264 of angled casing wall 254, thereby restricting water through sink aperture 278. Optionally, sink aperture 278 or lap joint rim 280 may be free of any corresponding gasket or O-ring to seal the board chamber 244.

In optional embodiments, metal heat sink 274 includes a plurality of fins 282. As shown, the plurality of fins 282 may extend away from board chamber 244. For instance, the plurality of fins 282 may extend from the sink platter 276 through sink aperture 278. As a result, the plurality of fins 282 may be exposed to the surrounding region of outdoor portion 110 (e.g., to exchange heat therewith). In some such embodiments, the plurality of fins 282 are inward from (e.g., surrounded by) the lap joint rim 280, which may thus be disposed around the plurality of fins 282. The plurality of fins 282 may extend in parallel to each other (e.g., such that the plurality of fins 282 are spaced apart from each other and do not directly touch an adjacent fin). Additionally or alternatively, the plurality of fins 282 may extend parallel to the angled casing wall 254 (e.g., along the wall angle θ). Water passing along the exterior of electronics casing 242 may thus be directed downward along the wall angle θ or angled casing wall 254.

Within the board chamber 244, an electronics board 240 may be mounted, as generally indicated above. In particular, electronics board 240 may be mounted in thermal communication (e.g., conductive thermal communication) with metal heat sink 274 (e.g., at the sink platter 276). Electronics board 240 may be held directly on metal heat sink 274 or, alternatively, connected to the same via one or more conductive elements. Optionally, a plurality of standoffs 284 may hold the electronics board 240 to the metal heat sink 274. As shown, electronics board 240 may be located directly beneath vertical opening 252. Additionally or alternatively, electronics board 240 may be spaced apart from the plurality of sidewalls 250. In embodiments wherein the arched interior ridge 256 is provided, electronics board 240 may be spaced apart from arched interior ridge 256 (e.g., proximal to bottom casing end 248 relative to arched interior ridge 256). In other words, arched interior ridge 256 may be disposed on the angled casing wall 254 above the electronics board 240. Moreover, electronics board 240 may be inward from arched interior ridge 256. Thus, the terminal ends of arched interior ridge 256 may be disposed closer to opposing sidewalls 250 than electronics board 240. Water within board chamber 244 may, in turn, be notably directed around electronics board 240 if not beneath the same.

Within the outdoor portion 110, an internal shield 310 may be disposed. In particular, internal shield 310 is disposed forward from outdoor inlet 128. Thus, internal shield 310 may be located closer to forward front end 114E (e.g., relative to the transverse direction T) than outdoor inlet 128, which is generally defined at the rearward back end 114E. Internal shield 310 may include or be provided as a solid and generally impermeable surface that prevents the flow of air or water through the same (e.g., along the transverse direction T). In some such embodiments, internal shield 310 is formed from one or more rigid panels (e.g., of a steel or aluminum sheet metal). As will be described in greater detail below, although internal shield 310 is generally impermeable, one or more passages may be defined through the same.

Within the outdoor portion 110, internal shield 310 extends between an upper edge 312 and a lower edge 314. Moreover, internal shield 310 may further extend along the direction L. In optional embodiments, internal shield 310 extends along the lateral direction L (e.g., continuously) from first lateral side 114C to second lateral side 114D. Thus, internal shield 310 may span the entire lateral width of outdoor portion 110. In certain embodiments, outdoor inlet 128 being disposed between the upper edge 312 and the lower edge 314 relative to the vertical direction V. Thus, internal shield 310 may span the entire vertical height defined by outdoor inlet 128. During use, air flowing parallel to the transverse direction T may be forced against or along a rearward-facing surface of the internal shield 310.

In certain embodiments, internal shield 310 is offset or spaced apart from the bulkhead 134. For instance, internal shield 310 may be disposed rearward from indoor air conduit 174 and fan cowl 170. In some such embodiments, one or more support brackets 316 extend from bulkhead 134 and attach internal shield 310 to bulkhead 134 while maintaining a transverse space or gap between internal shield 310 and bulkhead 134. In particular, multiple support brackets 316 secured to indoor air conduit 174 may extend along the transverse direction T to rest against and support internal shield 310.

While internal shield 310 is disposed rearward from indoor air conduit 174 and fan cowl 170, internal shield 310 may span at least a portion of the vertical height of bulkhead 134. For instance, upper edge 312 may be disposed above the cowl outlet 172 or intersection line 176 relative to the vertical direction V while lower edge 314 is disposed below the cowl outlet 172 or intersection line 176 relative to the vertical direction V. Notably, any liquid or moisture that accumulates on the rearward-facing surface of internal shield 310 may be maintained rearward of intersection line 176, thereby preventing such liquid or moisture from inadvertently passing from the outdoor portion 110 to the indoor portion 112 or path of air to the indoor outlet 140. Separate from or in addition positioning relative to the bulkhead 134, internal shield 310 may be offset or spaced apart from electronics casing 242. For instance, internal shield 310 may be disposed rearward from electronics casing 242. Moreover, internal shield 310 may span at least a portion of the vertical height of electronics casing 242. For instance, upper edge 312 may be disposed above a bottommost edge or weep hole 258 of electronics casing 242 relative to the vertical direction V while lower edge 314 is disposed below the bottommost edge or weep hole 258 relative to the vertical direction V. Notably, any liquid or moisture that accumulates on the rearward-facing surface of internal shield 310 may be maintained rearward of electronics casing 242, thereby preventing such liquid or moisture from inadvertently passing from the outdoor portion 110 to the board chamber 244.

In some embodiments, lower portions of internal shield 310 are located forward from upper portions of internal shield 310. Specifically, the lower edge 314 may be disposed forward from the upper edge 312. As shown, internal shield 310 may be generally slanted or curved (e.g., at one or more discrete segments, such as one or more vertical segments and one or more slanted segments, which are not parallel to the vertical direction V) such that the overall trend of the internal shield 310 is to move forward and downward from the upper edge 312. For instance, the slant or curved shape defined by a vertical cross-section of internal shield 310 may generally follow or complement an enlarged or rearward flare of indoor air conduit 174 from cowl outlet 172 to indoor outlet 140. Nonetheless, a downward-extending flared bottom lip 318 angled may be provided at the lower edge 314. Such a flared bottom lip 318 may extend rearward from a vertical segment of internal shield 310, for instance, at an angle of between 10° and 60° relative to the vertical direction V. Optionally, flared bottom lip 318 may be disposed above the intersection line 176 relative to the vertical direction V (e.g., such that the flared bottom lip 318 at a higher vertical height than intersection line 176 even though flared bottom lip 318 is disposed rearward from indoor air conduit 174 and fan cowl 170 relative to the vertical direction V).

As noted above, internal shield 310 may define an opening or transverse passage to permit air forward across internal shield 310. In some such embodiments, internal shield 310 defines an upper gap 320 that extends along the transverse direction T. In turn, air within outdoor portion 110 may be permitted to flow through the internal shield 310 to an outer surface of the indoor air conduit 174 or electronics casing 242 (e.g., to the metal heat sink 274). In some such embodiments upper edge 312 defines upper gap 320 with an interior surface of housing 114 (e.g., at the top wall thereof). Generally, the vertical size of upper gap 320 may be small. For instance, the vertical height of upper gap 320 (e.g., between upper edge 312 interior surface of housing 114 at the top wall thereof) may be less than 2 inches (e.g., less than 1 inch, 0.5 inches, or 0.1 inches). Additionally or alternatively, the vertical height of the upper gap 320 may be more than 0.01 inches (e.g., greater than 0.02 inches, 0.04 inches, or 0.06 inches).

Figure 6:
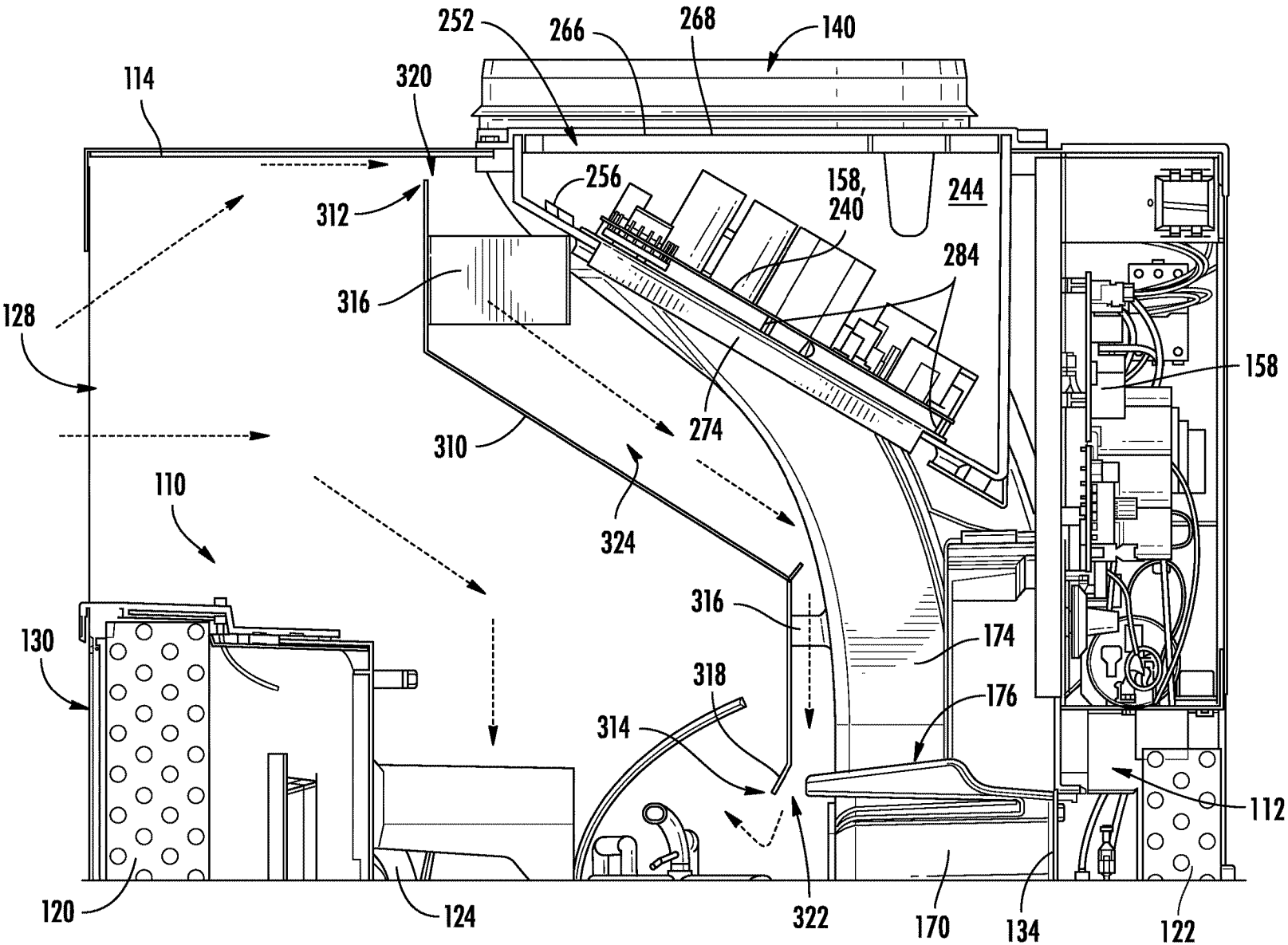
FIG. 6 provides a cross-sectional elevation view of an upper portion of the exemplary air conditioner unit of FIG. 1, taken along the lines 6-6, wherein a portion of a secondary air duct has been removed for clarity.

Downstream from the upper gap 320, internal shield 310 may define a lower gap 322 (e.g., at the bottom edge). An ancillary air path 324 may be defined between upper gap 320 and lower gap 322. In particular, ancillary air path 324 may be defined (e.g., along the transverse direction T) as the space between internal shield 310 and bulkhead 134 or electronics casing 242. Air may, thus, be permitted from upper gap 320, to ancillary air path 324 (e.g., to flow along a portion of the outer surface of indoor air conduit 174 or electronics casing 242), and to lower gap 322. In particular, and as illustrated in FIG. 6, during activation of outdoor fan 124, at least a portion of the outdoor air from outdoor inlet 128 may be directed through upper gap 320 and downward along ancillary air path 324 before flowing out of lower gap 322 as such air is drawn to outdoor fan 124. The remaining portion of the outdoor air (e.g., a majority of the outdoor air) may bypass the ancillary air path 324 and flow directly to the outdoor fan 124 or outdoor heat exchanger 120. Notably, airflow may be maintained along the electronics casing 242 or heat sink 274, thereby preventing stagnation, while also ensuring significant air is able to flow uninterrupted or easily to the outdoor fan 124.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A single-package air conditioner unit defining a mutually-perpendicular vertical direction, lateral direction, and transverse direction, the single-package air conditioner unit comprising:

a housing extending along the transverse direction between a forward front end and a rearward back end and along the vertical direction between a downward bottom end and an upward top end, the housing defining an outdoor portion proximal to the rearward back end and an indoor portion proximal to the forward front end;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan, the indoor fan being held within a fan cowl defining a cowl outlet;

an indoor air conduit mounted to the fan cowl and extending upward from the cowl outlet to an indoor outlet defined through the housing to guide air from the indoor fan, the indoor air conduit and the fan cowl separating at least a portion of the indoor portion from the outdoor portion; and an internal shield disposed within the outdoor portion rearward from the indoor air conduit and the fan cowl, the internal shield extending between an upper edge and a lower edge, the lower edge being disposed between the downward bottom end and the cowl outlet relative to the vertical direction, wherein the housing extends along the lateral direction between a first lateral side and a second lateral side, and wherein the internal shield extends continuously in the lateral direction and is disposed against the first lateral side and the second lateral side.

2. The single-package air conditioner unit of claim 1, wherein the lower edge is disposed forward from the upper edge.

3. The single-package air conditioner unit of claim 1, wherein the internal shield defines an upper gap extending along the transverse direction to permit air forward through the internal shield to an outer surface of the indoor air conduit.

4. The single-package air conditioner unit of claim 1, wherein the internal shield comprises a flared bottom lip angled rearward away from the indoor air conduit to the lower edge.

5. The single-package air conditioner unit of claim 1, wherein the housing further defines an outdoor inlet at the rearward back end, the outdoor inlet being disposed between the upper edge and the lower edge relative to the vertical direction.

6. The single-package air conditioner unit of claim 5, wherein the internal shield defines an upper gap extending along the transverse direction to permit air forward through the internal shield to an ancillary air path defined from the upper gap to a lower gap defined at the lower edge.

7. The single-package air conditioner unit of claim 6, further comprising:

an electronics casing disposed in the outdoor portion apart from the outdoor heat exchanger and along the ancillary air path, the electronics casing defining a board chamber;

a metal heat sink mounted to the electronics casing; and an electronics board mounted within the board chamber in thermal communication with the metal heat sink.

8. The single-package air conditioner unit of claim 7, wherein the electronics casing is disposed above the cowl outlet relative to the vertical direction.

9. The single-package air conditioner unit of claim 7, wherein the electronics casing is laterally spaced apart from the indoor air conduit.

10. The single-package air conditioner unit of claim 7, wherein the electronics casing comprises an angled casing wall extending along a wall angle that is non-orthogonal and non-parallel relative to the vertical direction.

11. A single-package air conditioner unit defining a mutually-perpendicular vertical direction, lateral direction, and transverse direction, the single-package air conditioner unit comprising:

a housing extending along the transverse direction between a forward front end and a rearward back end and along the vertical direction between a downward bottom end and an upward top end, the housing defining an outdoor portion proximal to the rearward back end and an indoor portion proximal to the forward front end;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan, the indoor fan being held within a fan cowl defining a cowl outlet;

an indoor air conduit mounted to the fan cowl and extending upward from the cowl outlet to an indoor outlet defined through the housing to guide air from the indoor fan, the indoor air conduit and the fan cowl separating at least a portion of the indoor portion from the outdoor portion; and an internal shield disposed within the outdoor portion rearward from the indoor air conduit and the fan cowl, the internal shield extending between an upper edge and a lower edge, the lower edge being disposed between the downward bottom end and the cowl outlet relative to the vertical direction, wherein the internal shield defines an upper gap extending along the transverse direction to permit air forward through the internal shield to an outer surface of the indoor air conduit.

12. The single-package air conditioner unit of claim 11, wherein the internal shield comprises a flared bottom lip angled rearward away from the indoor air conduit to the lower edge.

13. The single-package air conditioner unit of claim 11, wherein the housing further defines an outdoor inlet at the rearward back end, the outdoor inlet being disposed between the upper edge and the lower edge relative to the vertical direction, and wherein the upper gap extends along the transverse direction to permit air forward through the internal shield to an ancillary air path defined from the upper gap to a lower gap defined at the lower edge.

14. The single-package air conditioner unit of claim 11, further comprising:

an electronics casing disposed in the outdoor portion apart from the outdoor heat exchanger and along the ancillary air path, the electronics casing defining a board chamber;

a metal heat sink mounted to the electronics casing; and an electronics board mounted within the board chamber in thermal communication with the metal heat sink.

15. The single-package air conditioner unit of claim 14, wherein the electronics casing comprises an angled casing wall extending along a wall angle that is non-orthogonal and non-parallel relative to the vertical direction.

16. A single-package air conditioner unit defining a mutually-perpendicular vertical direction, lateral direction, and transverse direction, the single-package air conditioner unit comprising:

a housing extending along the transverse direction between a forward front end and a rearward back end and along the vertical direction between a downward bottom end and an upward top end, the housing defining an outdoor portion proximal to the rearward back end and an indoor portion proximal to the forward front end;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan, the indoor fan being held within a fan cowl defining a cowl outlet;

an indoor air conduit mounted to the fan cowl and extending upward from the cowl outlet to an indoor outlet defined through the housing to guide air from the indoor fan, the indoor air conduit and the fan cowl separating at least a portion of the indoor portion from the outdoor portion; and an internal shield disposed within the outdoor portion rearward from the indoor air conduit and the fan cowl, the internal shield extending between an upper edge and a lower edge, the lower edge being disposed between the downward bottom end and the cowl outlet relative to the vertical direction, wherein the housing further defines an outdoor inlet at the rearward back end, the outdoor inlet being disposed between the upper edge and the lower edge relative to the vertical direction, and wherein the internal shield defines an upper gap extending along the transverse direction to permit air forward through the internal shield to an ancillary air path defined from the upper gap to a lower gap defined at the lower edge.

17. The single-package air conditioner unit of claim 16, wherein the internal shield comprises a flared bottom lip angled rearward away from the indoor air conduit to the lower edge.

18. The single-package air conditioner unit of claim 16, further comprising:

an electronics casing disposed in the outdoor portion apart from the outdoor heat exchanger and along the ancillary air path, the electronics casing defining a board chamber;

a metal heat sink mounted to the electronics casing; and an electronics board mounted within the board chamber in thermal communication with the metal heat sink.

19. The single-package air conditioner unit of claim 18, wherein the electronics casing is disposed above the cowl outlet relative to the vertical direction.

20. The single-package air conditioner unit of claim 18, wherein the electronics casing comprises an angled casing wall extending along a wall angle that is non-orthogonal and non-parallel relative to the vertical direction.

* * * * *